United States Patent [19]

Furia

[11] Patent Number: 4,989,424

[45] Date of Patent: Feb. 5, 1991

[54] NEEDLE SELECTION DEVICE FOR A CIRCULAR KNITTING MACHINE, PARTICULARLY FOR LADIES' STOCKINGS

[75] Inventor: Edoardo Furia, San Casciano Val Di Pesa, Italy

[73] Assignee: Savio, SpA, Pordenone, Italy

[21] Appl. No.: 335,718

[22] Filed: Apr. 10, 1989

[30] Foreign Application Priority Data

Jan. 10, 1989 [IT] Italy ..... 9304 A/89

[51] Int. Cl.[5] ..... D04B 15/78

[52] U.S. Cl. ..... 66/219

[58] Field of Search ..... 66/215-216, 66/219-221

[56] References Cited

U.S. PATENT DOCUMENTS

| | | | |
|---|---|---|---|
| 3,262,285 | 7/1966 | Beguin et al. | 66/220 |
| 3,499,300 | 4/1970 | Zahrádka | 66/220 |
| 3,987,646 | 10/1976 | Knourek et al. | 66/220 |
| 4,570,463 | 2/1986 | Otto | 66/221 |
| 4,715,198 | 12/1987 | Ploppa et al. | 66/219 |
| 4,793,159 | 12/1988 | Sawazaki | 66/220 |

FOREIGN PATENT DOCUMENTS

| | | | |
|---|---|---|---|
| 2445291 | 4/1976 | Fed. Rep. of Germany | 66/219 |
| 2252431 | 7/1975 | France | 66/219 |
| 2058848 | 4/1984 | United Kingdom | 66/220 |

*Primary Examiner*—Werner H. Schroeder
*Assistant Examiner*—John Calvert
*Attorney, Agent, or Firm*—Hedman, Gibson, Costigan & Hoare

[57] ABSTRACT

This invention relates to an electronically controlled electromagnetic needle selection device which is used in the in a circular knitting machine. The device operates in the direction of the needle cylinder rotation and can include reciprocating motion. It is used particularly for making ladies' stockings and includes a cylinder with needles and elastic pusher jacks which are housed in corresponding longitudinal grooves. Each pusher jack is provided with three butts: an upper butt which cooperates with a first ring cam for lowering into the selection position, an intermediate butt which cooperates with a presser cam in the centripetal direction, and a lower butt provided with a cam for raising the pusher jack to activate the corresponding needle. The device also has a rim structure fixed to the needle cylinder and provided, in line with each pusher jack, with a radial horizontal groove for housing an elastic selector. This has its foot fitted onto the outer circumference of the rim structure and its head underlying the foot of the pusher jack when the jack is in its rest position. The device further has a selection electromagnet interposed between two permanent retaining magnets and fixed under each horizontal elastic selector. The electromagnet cooperates with the selector when it is urged against the electromagnet by the foot of the pusher jack to preferentially select the corresponding lower butt of the pusher jack after its intermediate butt has passed along the presser cam.

9 Claims, 5 Drawing Sheets

NEEDLE SELECTION DEVICE FOR A CIRCULAR KNITTING MACHINE, PARTICULARLY FOR LADIES' STOCKINGS

This invention relates to an electromagnetic needle selection device for a circular knitting machine having reciprocating motion. It is particularly used for ladies' stockings.

Circular knitting machines are known to use one or more needle selection units disposed about a cylinder before each feed. Each unit consists of an electromagnet having a maximum width equal to the distance between one needle and the next and interposed between two permanent magnets. The unit further has and a presser cam disposed in correspondence with that magnet which is upstream of the electromagnet, in the direction of advancement of the cylinder, to urge a rocking selector associated with and overlying an elastic pusher jack against the cylinder.

The electromagnet is pulse-operated. This is accomplished by a current passage, current interruption, or direction reversal, according to an electronic program which is synchronized with the movement of the needle cylinder. This is to selectively keep the rocking selector attracted and/or adhering to the magnets and to prevent the butt of the elastic jack from engaging a control cam and inactivating the corresponding needle. It is also to prevent weakening of the magnetic field generated by the permanent magnets and thus release, i.e. repel, the rocking selector. This causes the butt of the elastic jack to be raised by the control cam and to activate the corresponding needle. Such a selection system, as described for example in U.S. Pat. No. 3,972,206, has various drawbacks, such as the fact that the cylinder grooves must be sufficiently deep to house the elastic pusher jack and the rocking selector in an associated and superposed relationship. This is because such a configuration is possible only for low fineness values; for fineness values exceeding 14, the cylinder walls become too thin and weak. This compromises very deep milling.

The use of barred cylinders results in constructional advantages and allows grooves to be formed with constant thickness walls and smooth surfaces which are hard, elastic and robust; however the radial arrangement of the bars means that the width of the grooves is greater at their periphery than at their base, and this difference, which increases as the depth of the grooves increases, causes serious clearance problems between the walls and the rocking and sliding members. The radial arrangement also causes problems in controlling the friction and force equilibrium.

In addition, as the elastic jacks are in direct relationship with the electromagnets by way of the rocking selectors, the requirement for rapid and reliable response at high speed and high fineness values means that the outward elastic force of the elastic jacks, when in their working position, must be high. This is to ensure response rapidity in the case of non-selection. Therefore, the attraction force of the selection electromagnets must overcome this elastic force to keep the elastic jack in its non-working position. However this attraction force is limited by the magnetic flux passage cross-section of the electromagnets. This passage is itself limited by the available space between one needle and the next. When the saturation level has been attained there is no way in which this attraction force can be increased, not even by increasing the number of turns or the current intensity. This limitation, which increases with increasing fineness value, endangers the equilibrium between the elastic reaction, the inertia of the moving parts, friction, centrifugal force, and etc.

On the other hand, although a reduction in the elastic force of the elastic jacks means that the electromagnets can provide better retention with a more easily attainable magnetic force, this reduction compromises the separation of the rocking selectors from the magnet during selection because of the large lever arm and the high centrifugal force involved at high speed. The combination of these limitations and stresses means that systems of the aforesaid type are inadequate and are unable to respond to fineness, speed and reliability requirements.

With the system described in U.S. Pat. No. 4,020,652, which comprises two superposed electromagnetic actuators acting on rocking selectors provided with two butts at corresponding height, the time available for selecting each individual needle can be doubled. However the available space for, and therefore the force of, the electromagnets are always limited because they are unsuitable for high fineness values. For the same reasons, these electromagnets do not solve the initially stated problems relating to the equilibrium between the elastic, magnetic, centrifugal, friction and centrifugal forces, and to the difficulties of construction.

GB patent 2,112,822 describes an electromagnetic selection system in which the upper end of each rocking jack is designed to urge the lower end of the corresponding overlying needle or needle pusher outwards to allow it to engage a control cam. The lower end of the vertical jack is acted upon by an intermediate horizontal jack. This intermediate jack slides longitudinally and rocks vertically in a radial groove of an external annular body. The annular body is rigid with the needle cylinder. The intermediate jack is associated with an underlying supplementary vertical selector jack which is housed in a vertical groove in the annular body parallel to that housing the main jack but lying on a circumference of greater radius. In front of the supplementary jack there is an electromagnet. Under the butt of the jack there is a fixed cam which, when the electromagnet is not energized, urges the supplementary jack upwards so that the foot of the intermediate jack is urged centripetally by a cam in such a manner that it acts on the lower end of the main jack. The main jack then selects the corresponding needle. However, even assuming this device provides a greater space for the selection electromagnets by disposing them on a larger-radius circumference of the needle cylinder and avoids superposing the main jack and the selector jack in the same groove of the needle cylinder, it nevertheless increases the constructional complexity of the machine. This is due to the large number of components and the variety of movements effected. Further, it does not solve the force equilibrium problem, particularly regarding centrifugal and elastic forces, and therefore does not seem able to allow the needle cylinder to operate at the required speed. The object of the present invention is to obviate the aforesaid drawbacks and limitations by providing a device which is adaptable to standard-groove circular knitting machines. The device implements the needle selection for fineness values exceeding 14 needles/inch as required in the manufacture of ladies' stockings. This device further offers great reliability even at the highest speeds currently obtainable and at the same time is of simple low-cost construction.

This result is attained according to the invention by using for each needle an elastic pusher jack provided with three butts at different heights. An upper butt cooperates with a ring cam for lowering it into the selected position. An intermediate butt cooperates in the selected position, and has a presser cam centripetal to the cylinder. A lower butt is provided in a position which corresponds with a ring cam for raising the pusher jack to activate the corresponding needle. The device also has an elastic selector housed horizontally in a radical groove. The radial groove is provided in the lower surface of a rim structure which is rigidly fixed about the needle cylinder. The foot is of the elastic selector anchored to the outer circumference of the rim structure and its head is underlying the foot of the pusher jack when the elastic selector is in its rest position. The device further includes a selection electromagnet interposed between two permanent retaining magnets and underlying each horizontal elastic selector. The electromagnet cooperates with the selector when the electromagnet is urged against the selector by the foot of the pusher jack under the action of the lowering cam. This is to either select or not select the corresponding intermediate butt of the pusher jack after its passage past the presser cam.

The device is also provided with a ring fixed onto the needle cylinder in a position underlying the horizontal elastic selectors. This is to keep the selectors, when they are attracted by the electromagnets, slightly spaced from the permanent magnets and from the electromagnets to reduce the magnet wear and the force resisting sliding.

According to a preferred embodiment of the invention, the upper butts of the pusher jacks of even courses are disposed at a different height from the pusher jacks of the odd course. This is so they are lowered in sequence into the selection position in correspondence with two electromagnetic actuators which are also operated in sequence. This arrangement doubles the time and space available for selecting each individual needle and thereby increases the operational reliability for higher fineness values and speeds without reducing the constructional simplicity.

The solution proposed by the present invention enables an electromagnetic selection device to be provided to be of simple construction, and is adaptable to standard cylinders at low cost. This is because the particular arrangement of the elastic selectors solves the problem of balancing the forces in play, thereby allowing operation at the required speeds and fineness values. It is particularly useful in the manufacture of ladies' stockings.

These and further advantages and characteristics of the invention will be more apparent to one skilled in the art from the description given hereinafter and with reference to the accompanying drawings, which are given by way of non-limiting example.

Figure 1:
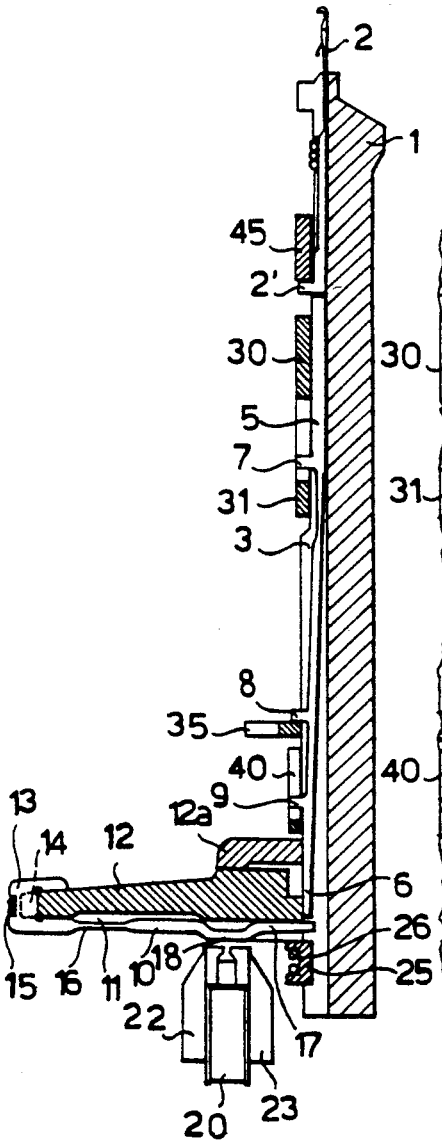
FIG. 1 is a radial section through the needle cylinder with a selection device and shown in its initial position, i.e. before the selection stage.
Figure 2:
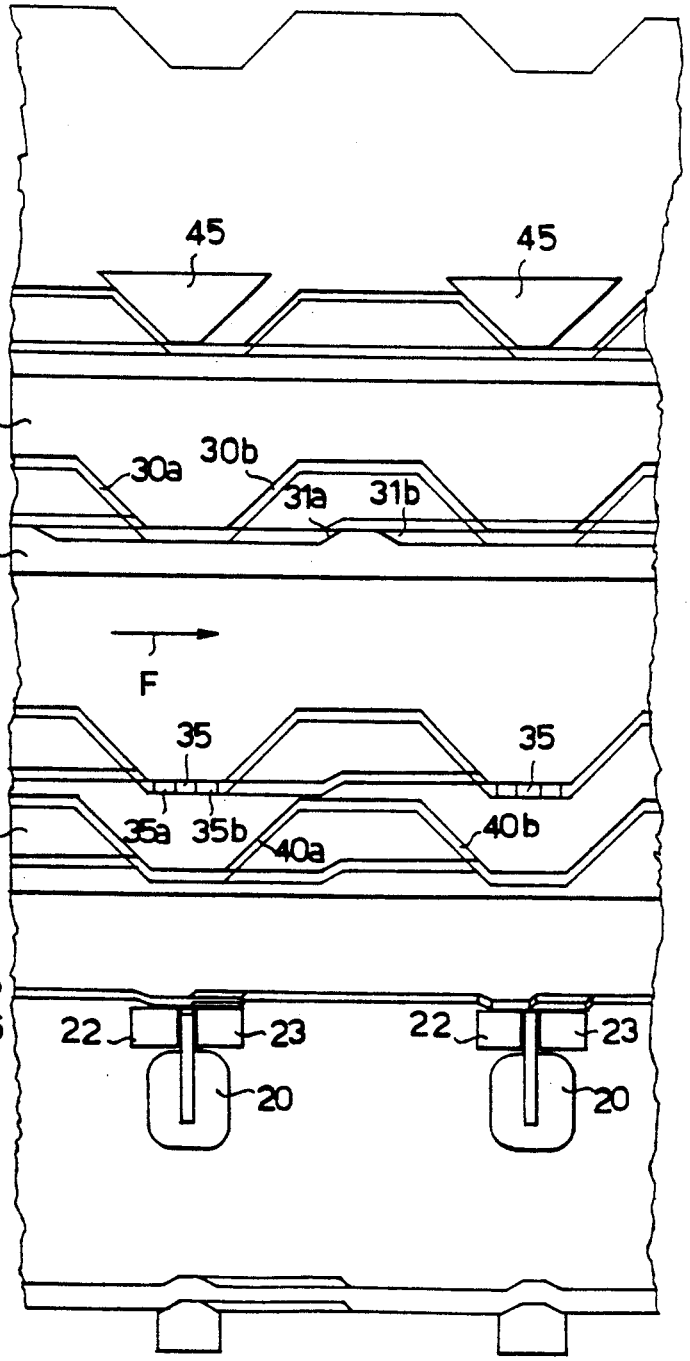
FIG. 2 is a developed view of the cam skirt for the selection device of FIG. 1.

With reference to FIGS. 1 and 2 of the accompanying drawings, a device is disclosed for an electronically controlled electromagnet selection, needle by needle, in a circular knitting machine having reciprocating motion. It is useful in particular, for ladies' stockings, and compromises the following features.

A vertical elastic pusher jack 5 longitudinally slidable in a corresponding groove 3 of the cylinder 1 with its head in contact with the lower side of the butt of a relative needle 2, and elastically flexible in a direction radial to the cylinder 1. Its rest position is shown with its foot 6 separated from the base of the groove 3. The jack 5 is also provided with three butts 7, 8, 9 of which the upper butt 7 is for selecting, and the intermediate butt 8 and lower butt 9 are for activating the corresponding needle at two different levels. The device is further provided with a horizontal elastic selector 10 housed in a radial groove 11. This is in line with the groove 3 for the corresponding jack 5. The radial groove 11 is provided in the lower face of a rim structure 12 and is rigidly fixed about the needle cylinder 1. The foot 13 of said selector 10 is of C-shape to enable it to be mounted over the outer circumference of said rim 12 in a corresponding vertical slot 14 and urged into its seat, in the centripetal direction, by two ring springs 15. The body of the selector 10 comprises, in proximity to its foot, a zone 16 of reduced cross-section to enable the head 17 to flex in a vertical direction. When it is in its rest position, the head 17 rests against the base of its relative groove in the rim structure 12 and partly penetrates into the groove 3 housing the pusher jack 5 in a position below its foot 6. When in the rest position, the rear of said pusher jack 5 in proximity to its foot is in contact with the inner edge of the rim structure 12 and with an overlying ring **12*a* which is fixed onto said rim structure to provide a means for fixing this latter to the needle cylinder 1. Finally, the body of said horizontal selector 10 has a middle zone 18 which is slightly offset downwards with respect to the longitudinal axis to define the attraction section for the electromagnet. Also included in this device is a selection electromagnet 20 which is interposed between two permanent retention magnets 22 and 23 mounted on the fixed part of the machine under said rim structure 12 in correspondence with the attraction section 18 of the selectors 10**.

A ring 25 which is composed of several sectors fitted together is kept in its seat against the outer surface of the needle cylinder 1 by two ring springs 26. It is in a position below the head 17 of the horizontal elastic selectors 10 to limit their downward travel and prevent contact between the attraction section 18 and the magnets 22 and 23 when in the selection position. This thus reduces magnet wear and the forces resistant to sliding.

Figure 3:
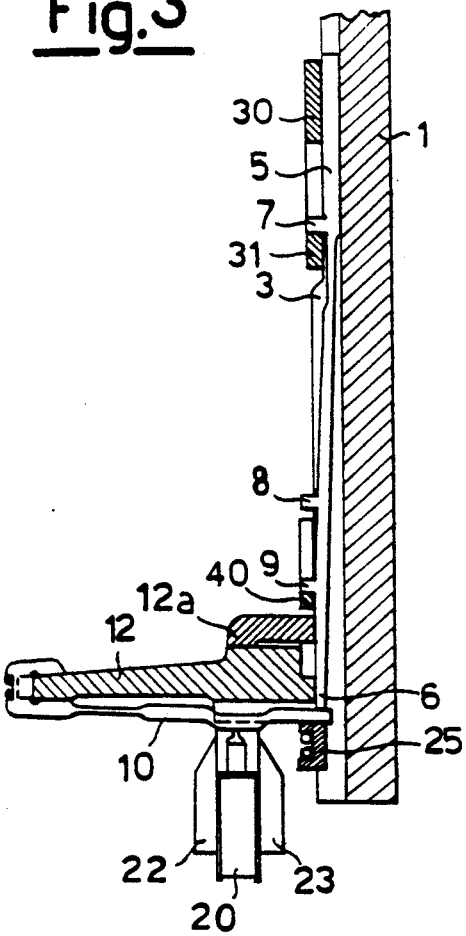
FIG. 3 is a diagrammatic view of the device of FIG. 1 showing the device in a position immediately before the selection for activating the corresponding needle and after the pusher jack has lowered the horizontal selector jack against the first permanent magnet.

Moreover, to select and control the needles, the selection device according to the invention uses conventional means. These means are, for example, two preselection ring cams 30 and 31 lying respectively above and below the upper butt 7 of the pusher jacks 5. The upper cam 30 comprises two ramps 30*a* and 30*b*, the lowest point of which is vertically above the outer end of the magnets 22 and 23 respectively, to enable the upper butt 7 of the pusher jacks 5 to be lowered into their lower selection position (see FIG. 3), i.e. in each of the two directions of motion of the needle cylinder. The lower cam 31 comprises two ramps 31*a* and 31*b* to enable the upper butt 7 of those pusher jacks not selected during the preceding selection stage to be raised into the initial intermediate preselection position, (see FIG. 1). The selection device also has a presser cam 35 disposed on the vertical axis of each electromagnet 20. Its symmetrical ramps 35*a* and 35*b* are arranged to engage the intermediate butt 8 of the corresponding pusher jack 5 of the lower selection position, during its passage in the two directions of motion of the needle cylinder respectively. A ring cam 40 is underlying the lower butt 9 of the pusher jacks 5 and comprises two ramps 40*a* and 40*b* which are arranged to raise the lower butt 9 of the selected pusher jacks 5 to activate the corresponding needle. A group of cams 45 of inverted isosceles trapezium shape acts on the butt 2' of the needles 2 to allow stitch formation in conventional manner.

The operation is as follows.

Figure 4:
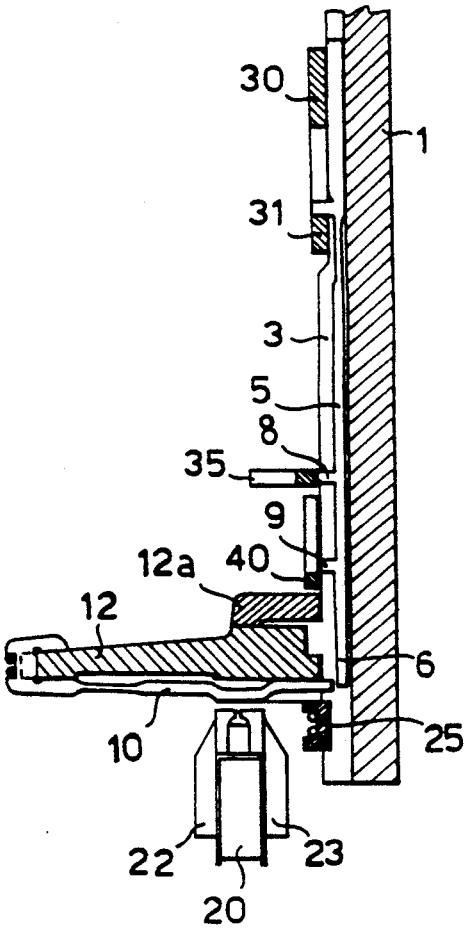
FIG. 4 is a diagrammatic view of the device of FIG. 1 after the selection for inactivating the corresponding needle.

The needle cylinder 1 moves in the direction of the arrow F. As each needle 2 with its pusher jack 5 and horizontal elastic selector 10 arrives at a selection unit, the pusher jack 5 is in the initial intermediate preselection position (see FIG. 1). The contour 30*a* of the cam 30 then lowers the pusher jack 5 into the lower selection position so that its foot 6 pushes the head 17 of the elastic selector 10 downwards against the stop ring 25 to enable the magnet 22 to keep the section 18 of the selector 10 attracted (see FIG. 3). The contour 35*a* of the pressure cam 35 then urges the intermedite butt 8 of the pusher jack 5 towards the inside of the cylinder 1, to release the head of the selector 10 which still remains attracted by the magnet 22. At this point one of the following two selections can be made: 1st slection. If the electromagnet 20 is not energized, the selector 10 rises to lock the foot 6 of the pusher jack 5 against the base of the relative groove 3 (see FIG. 4); the lower butt 9 of the jack 5 then passes beyond the cam 40 without being engaged by its contour 40*a*, to inactivate the corresponding needle 2, and proceeds along the lower track A behind said cam 40*a* until it reaches the next contour 31*a* of the cam 31 for its return to its initial preselection position ready for a further selection. 2nd selection. On energizing the electromagnet 20, the selector 10 remains attracted by the second magnet 23 and the foot 6 of the pusher jack 5 returns to its rest position against the inner edge of the rim structure 12 with the result that its lower butt 9 is engaged by the contour 40*a* of the cam 40 (see FIG. 3). By rising, it urges the corresponding needle into the activation position to allow stitch formation in conventional manner. After stitch formation the jack 5 is returned to its bottom selection position by the contour 30*a* of the cam 30 which acts on its upper butt 7.

Figure 5:
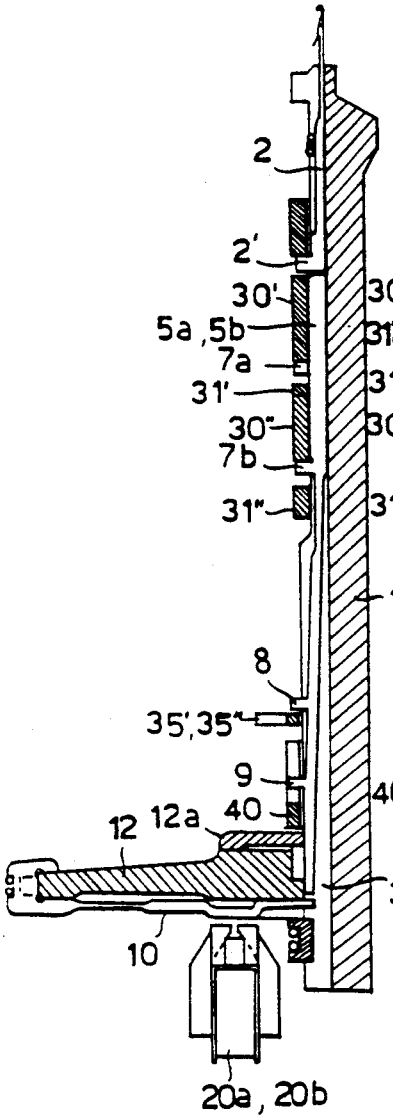
FIG. 5 is a radial section through the needle cylinder showing a modified selection device, according to the invention, in its initial position before the selection stage.
Figure 6:
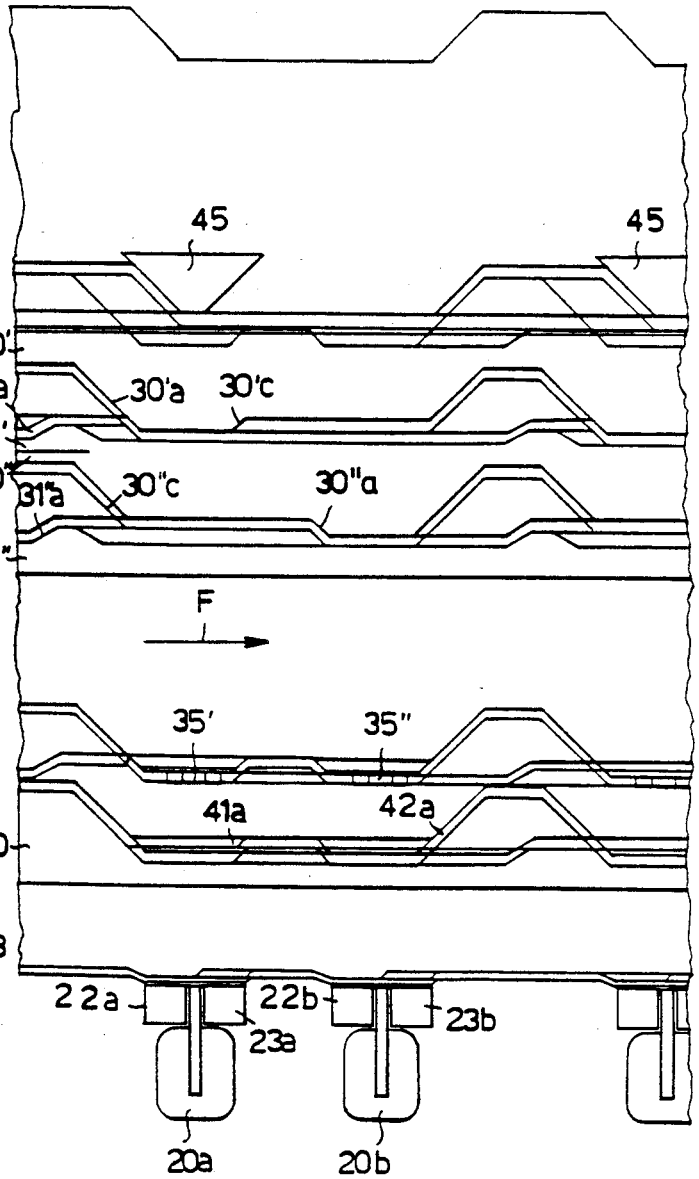
FIG. 6 is a developed view of the cam skirt for the selection device of FIG. 5.
Figure 7:
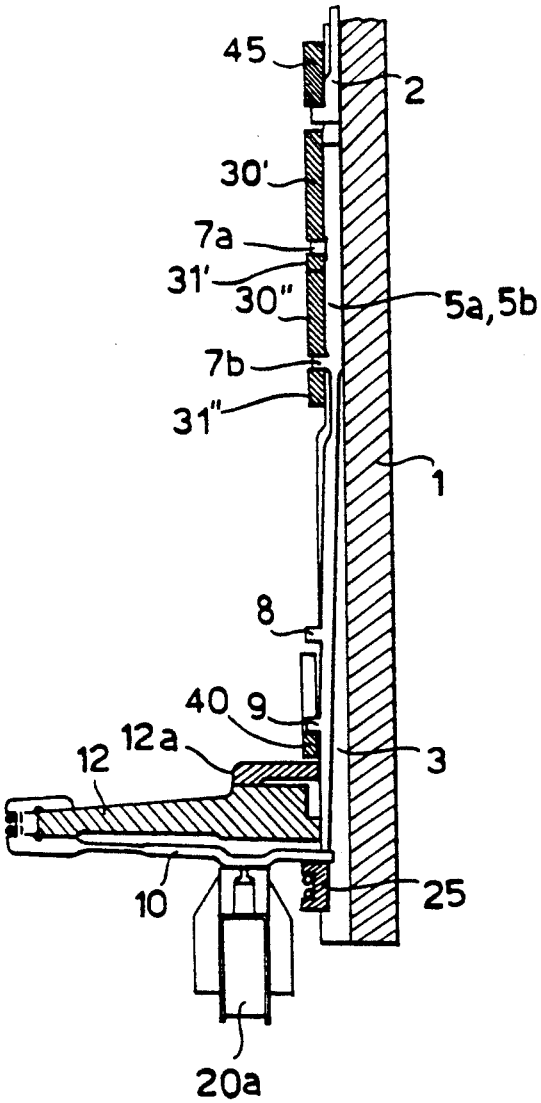
FIG. 7 is a diagrammatic view of the device of FIG. 5 immediately before the selection for activating the corresponding needle and with the selector jack lowered by the pusher jacket.
Figure 8:
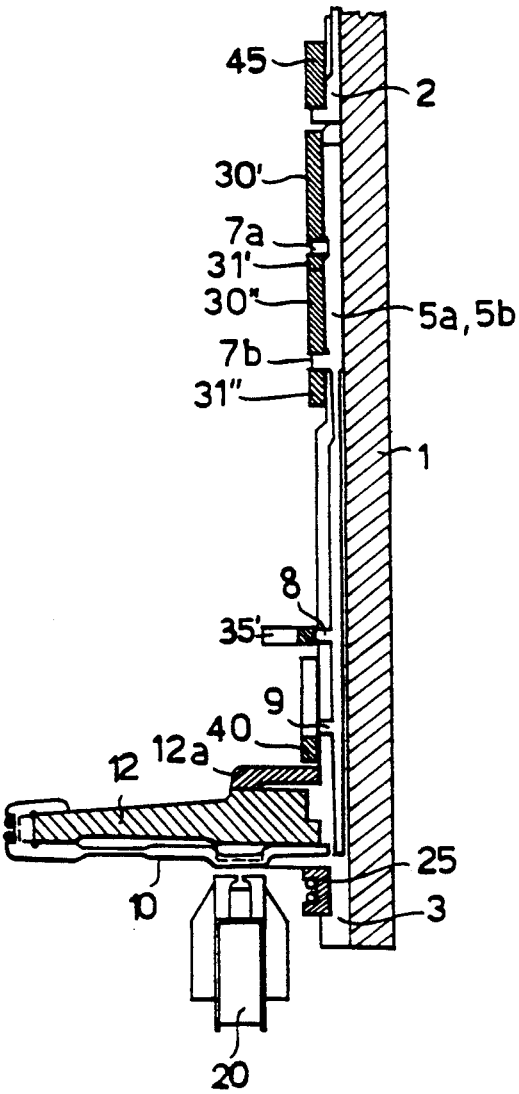
FIG. 8 is a diagrammatic view of the device of FIG. 5 after the selection for inactivating the corresponding needle.

FIGS. 5 and 8 of the accompanying drawings show a modified embodiment of the selection device according to the invention. This embodiment comprises, for each selection device:

two electromagnetic actuators each consisting of an electromagnet 20*a*, 20*b* interposed between two permanent magnets 22*a*, 23*a* and 22*b*, 23*b*, and disposed in sequence along the passage of the elastic selectors 10;

odd and even course pusher jacks 5*a*, 5*b* respectively, provided with an upper butt 7*a*, 7*b* at different heights so as to be separately engaged by two separate pairs of preselection cams 30', 30'' and 31', 31'';

two presser cams 35' and 35'' for selecting odd and even course jacks respectively, and disposed in a position corresponding with the respective electromagnetic actuator upstream of the contour 41*a* and 42*a* of the control cam 40.

The operation, which is similar to that of the preceding device but is divided into two stages, is as follows.

The odd pusher jacks 5*a* are lowered into their lower selection positions by respective contours 30'*a* of the cam 30', whereas the even jacks 5*b* are positioned by the profile 30''*a* or 31''*a* in the intermediate preselection position. The only odd jacks 5*a* are urged against the cylinder 1 by the first presser cam 35' and, if selected by the selectors 10 held attracted by the electromagnets 20*a*, they are raised into the intermediate position by the contour 41*a* of the cam 40 butt 7*a* following contour 30'*c* of cam 30' so as not to be engaged by the second presser cam 35'' or further raised by the control contour 42*a* of the cam 40. If they are not selected they pass beyond the cams 40 and 35'' without being affected by them. After the even course jacks 5*b* have passed beyond the presser cams 35' and 40 without being acted upon by them, they are lowered into the bottom selection position by the contour 30''*a* of the cam 30'' which acts on the butts 7*b* and are therefore selected by the presser cam 35'' and by the second actuators 20*b*. They are then either raised or not by the profile 42*a* of the cam 40 together with the odd course pusher jacks 5*a*.

Figure 11:
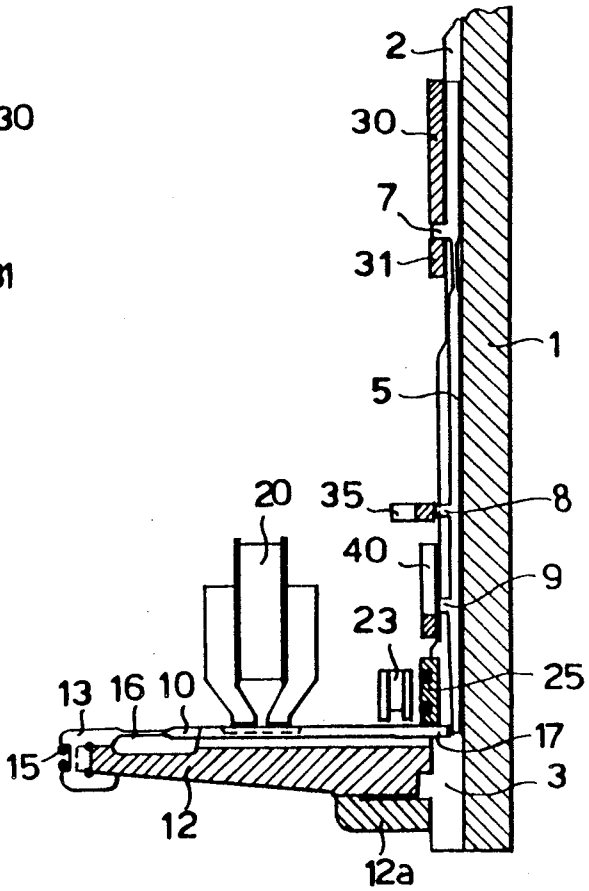
FIG. 11 is a diagrammatic view of the device of FIG. 9 during the selection stage.
Figure 10:
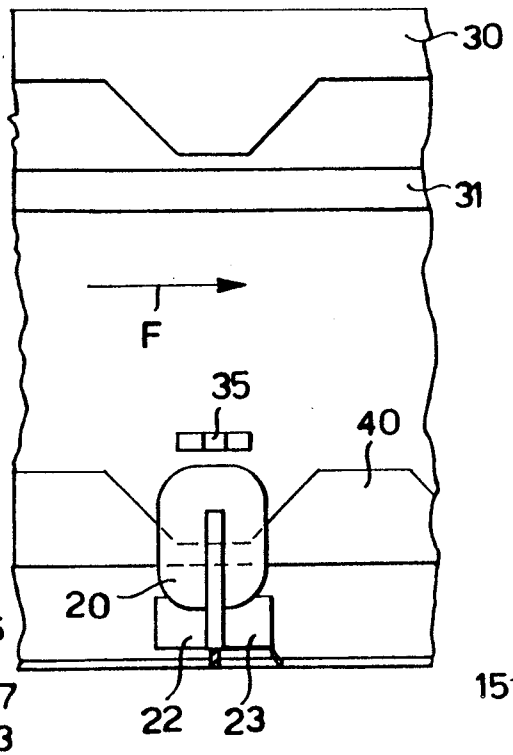
FIG. 10 is a developed view of the cam skirt for the device of FIG. 9.
Figure 9:
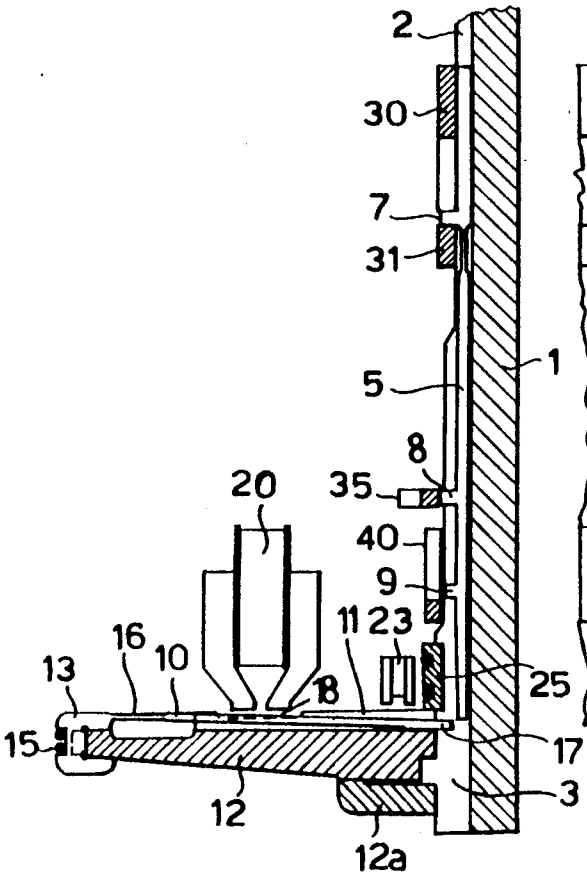
FIG. 9 is a radial section through the needle cylinder showing a further modified selection device, according to the invention, in its initial position before the selection stage, i.e. with all needles working.

FIGS. 9 to 11 of the accompanying drawings show a further embodiment of the device according to the invention which is particularly advantageous for higher fineness values. In this embodiment:

each horizontal elastic selector 10 is housed in a corresponding radial groove 11 provided in the upper face of the rim structure 12 with its head 17 resting, when it the rest position, on the base of the relative groove 11 and partly penetrating into the trick 3 of the corresponding pusher jack 5 under the foot of this latter;

the selection electromagnet 20 is mounted above said rim structure 12 in a position corresponding with the attraction section 18 of the selectors 10 but without making contact therewith during the attraction; and a permanent magnet 23 is mounted above the rim structure 12 in a position corresponding with the head 17 of the selectors 10. The magnetic force of said permanent magnet 23 of its distance from the selector 10 must be such that, in relation to the elastic reaction of the selector 10, it does not influence this latter when in its rest position, but be sufficient to keep it attracted against the ring 25, provided above the rim structure 12, during and after attraction by the selection electromagnet 20. The width of the pole pices of the electromagnet 20 in the direction of motion must be at most equal to the pitch of the selectors 10, and the width of the pole pieces of the permanent magnet 23 must be such as to keep the selected selectors 10 attracted and so keep the butt 9 of the pusher jacks 5 disengaged from the cam 40 even after the butt 8 has abandoned the presser cam 35.

The advantages of such an arrangement are essentially that no additional sliding of the pusher jacks 5 is required to activate the horizontal selectors 10 before selection; that these latter rock only when the needles are inactivated; and that it is not necessary to activate the electromagnets 20 when the needles are activated.

In practice the invention is susceptible to modifications in terms of the shape, dimensions and arrangement of its component elements and the type of materials used, but without leaving the scope of the inventive idea and therefore lying within the scope of protection of the present industrial invention patent.

I claim:

1. An electromagnetic device for selecting needles in a circular knitting machine, wherein the device has a rim structure fixed about a cylinder, wherein the device comprises:

(a) an elastic pusher jack for each needle, said jack having a head end for activating its corresponding needle and a foot end, wherein said jack is housed and is slidable in a groove of the cylinder and wherein said jack includes an upper butt, an intermediate butt, and a lower butt;

(b) a first ring cam in cooperation with said upper butt of said jack for lowering said jack into a lower needle selection position;

(c) a pressure cam in cooperation with said intermediate butt of said jack when said jack is in said lower needle selection position;

(d) a second ring cam in cooperation with said lower butt of said jack for raising said jack for activating the corresponding needle of said jack;

(e) a horizontal elastic selector having a head end located below and proximate to said foot of said jack wherein said head projects into said groove of the cylinder housing said jack and a foot end fixed in a vertical seat of the rim structure, wherein said horizontal elastic selector is rigidly fixed about the cylinder and housed in a radial groove of the rim structure;

(f) a ring spring attached to said foot of said horizontal elastic selector for retaining said foot in said vertical seat of the rim structure;

(g) a selection electromagnet located proximate said horizontal elastic selector for attracting said horizontal elastic selector when said electromagnet is activated; and (h) at least one permanent retaining magnet located proximate said horizontal elastic selector for attracting said horizontal elastic selector when said selection electromagnet is activated to selectively attract said lower butt of said jack after said intermediate butt of said jack has passed said presser cam so that said jack selects the corresponding needle.

2. The device of claim 1 wherein said selection electromagnet and said at least one permanent retaining magnet are located below said horizontal elastic selector.

3. The device of claim 2 further comprising two permanent retaining magnets wherein said selection electromagnet is interposed therebetween.

4. The device of claim 1 wherein said selection electromagnet and said at least one permanent retaining magnet are located above said horizontal elastic selector.

5. The device of claim 4 further comprising two permanent retaining magnets wherein said selection electromagnet is interposed therebetween.

6. The device of claims 1 or 4 wherein said horizontal elastic selector has a first zone proximate to its said foot end, wherein said first zone has a reduced cross-section.

7. The device of claim 2 wherein said horizontal elastic selector has a middle attraction zone proximate said first zone, wherein said middle attraction zone has a downwardly offset profile with respect to the longitudinal axis of said horizontal elastic selector.

8. The device of claims 2 or 3 further comprising a ring and a biasing means, wherein said ring is fixed to the cylinder proximate said head end of said horizontal elastic selector by said biasing means so that when said horizontal elastic selector is attracted by said selection electromagnet without touching said selection electromagnet or said permanent retaining magnet.

9. The device of claim 1 further comprising two selection electromagnets and two presser cams and wherein the cylinder includes a first groove and second groove each adapted for housing an elastic pusher jack, wherein said elastic pusher jack in said first groove is disposed at a different height than said elastic pusher jack in said second groove so that said upper butts of each respective elastic pusher jacks are sequentially lowered by said first ring cam into said lower needle selection position in said cooperation with said presser cams proximate to said two selection electromagnets.

* * * * *